United States Patent [19]

Frye et al.

[11] 4,313,979

[45] Feb. 2, 1982

[54] METHOD FOR IMPROVING ADHESION OF SILICONE RESIN COATING COMPOSITION

[75] Inventors: Robert B. Frye, Albany; James T. Conroy, Green Island, both of N.Y.

[73] Assignee: General Electric Company, Waterford, N.Y.

[21] Appl. No.: 190,812

[22] Filed: Sep. 25, 1980

[51] Int. Cl.[3] ..... B05D 3/02

[52] U.S. Cl. ..... 427/387; 106/287.12; 106/287.13; 260/29.2 M; 427/412.1; 427/412.5

[58] Field of Search ..... 260/29.2 M; 427/387, 427/412.1; 106/287.12, 287.13; 156/307.3

[56] References Cited

U.S. PATENT DOCUMENTS

| | | | |
|---|---|---|---|
| 3,342,766 | 9/1967 | Huntington | 260/29.6 NR |
| 3,708,225 | 1/1973 | Misch et al. | 351/160 |
| 3,976,497 | 8/1976 | Clark | 106/287 SE |
| 3,986,997 | 10/1976 | Clark | 260/29.2 M |
| 4,027,073 | 5/1977 | Clark | 260/29.2 M |
| 4,159,206 | 6/1979 | Armbruster et al. | 106/287.12 |
| 4,177,315 | 12/1979 | Ubersax | 428/336 |

*Primary Examiner*—Theodore E. Pertilla

*Attorney, Agent, or Firm*—Hedman, Casella, Gibson & Costigan

[57] ABSTRACT

A method for maintaining or improving the adhesion of silicone resin coating compositions to acrylic-primed plastic substrates comprises adding to the aliphatic alcohol-water medium of the composition a small, effective amount of a miscible solvent which is capable of softening, but not dissolving, the acrylic primer layer.

17 Claims, No Drawings

METHOD FOR IMPROVING ADHESION OF SILICONE RESIN COATING COMPOSITION

BACKGROUND OF THE INVENTION

This invention relates to a method for improving protective coating compositions. More particularly, it relates to a method for improving silicone resin coating compositions adapted to be applied to a substrate, and thereby forming a protective abrasion-resistant coating thereon.

Recently, the substitution of glass glazing with transparent materials which do not shatter or are more resistant to shattering than glass, has become widespread. For example, transparent glazing made from synthetic organic polymers is now utilized in public transportation vehicles, such as trains, buses, taxis and airplanes. Lenses, such as for eyeglasses and other optical instruments, as well as glazing for large buildings, also employ shatter-resistant transparent plastics. The lighter weight of these plastics in comparison to glass is a further advantage, especially in the transportation industry where the weight of the vehicle is a major factor in its fuel economy.

While transparent plastics provide the major advantage of being more resistant to shattering than glass, a serious drawback lies in the ease with which these plastics mar and scratch, due to everyday contact with abrasives, such as dust, cleaning equipment and ordinary weathering. Continuous scratching and marring results in impaired visibility and poor aesthetics, and oftentimes requires replacement of the glazing or lens or the like.

One of the most promising and widely used transparent plastics for glazing is polycarbonate, such as that known as Lexan ®, sold by General Electric Company. It is a tough material, having high impact strength, high heat deflection temperature, good dimensional stability, as well as being self-extinguishing, and is easily fabricated.

Attempts have been made to improve the abrasion resistance of transparent plastics. For example, scratch-resistant coatings formed from mixtures of silica, such as colloidal silica or silica gel, and hydrolyzable silanes in a hydrolysis medium, such as alcohol and water, are known. U.S. Pat. Nos. 3,708,225, 3,986,997, 3,976,497 and 4,177,315, for example, describe such compositions.

Copending U.S. application entitled "Silicone Resin Coating Composition," by Howard A. Vaughn, Ser. No. 964,910, filed Nov. 30, 1978, discloses another abrasion-resistant coating composition. Copending Frye Application, Ser. No. 964,911, filed Nov. 30, 1978, describes the use of small amounts of polysiloxane polyether copolymers to promote coating formation. Copending Frye Application, Ser. No. 91,716, filed Nov. 6, 1978, describes the use of small amounts of ultraviolet screens to improve adhesion on weathering. Copending Kray application, Ser. No. 156,268, filed June 3, 1980, describes superior compositions for priming plastic substrates prior to top coating with the abrasion-resistant compositions; these generally comprise acrylic esters dissolved in a solvent which is somewhat aggressive to the plastic substrate. Somewhat aggressive in this sense means able to soften, but not dissolve. Copending Frye application, Ser. No. 34,164, filed Apr. 27, 1979, describes abrasion resistant coatings especially adapted to coating unprimed acrylic plastic substrates; in these, the alcohol in the composition is replaced with a more aggressive solvent, such as 2-ethoxyethyl acetate or a mixture thereof with 2-butanone. Copending Conroy application Ser. No. 107,994, filed July 18, 1980 discloses that diacetone alcohol, which also has aggressive characteristics of the type mentioned above, can be added to the abrasion resistant compositions to lower their curing temperature below 100° C. The foregoing patents and applications are incorporated herein by reference.

It has now been surprisingly discovered herein that the addition of a small amount of an aggressive solvent to the uv stabilized, polysiloxane polyether-containing coating compositions disclosed in the above mentioned Frye application Ser. No. 91,716 provides very important advantages.

Specifically, these prior compositions have a shelf life at room temperature of about one month. After this period, the initial adhesion to polycarbonate panels primed with a solution of the thermoplastic polyacrylate of the type described in the Kray application becomes variable and the resistance to weathering decreases. If, however, according to the present invention a small amount of a solvent, such as diacetone alcohol, 2,4-pentanedione, cyclohexanone, or ethoxyethyl acetate is added to the coating composition, adhesion will be maintained, as well as abrasion resistance and accelerated weathering resistance. It is significant that this simple step increases the useful life of the coating composition by two- or three-fold and this facilitates its handling (permitting longer transit times) and making diptanks more feasible (longer pot life). The step of this invention also has a decidedly unexpected rejuvenating effect on older compositions which, until now, lose their initial adhesion after standing. Adding the specific, aggressive solvents to such aged compositions restores them to their original state.

SUMMARY OF THE INVENTION

Accordingly, it is one object of the present invention to provide an improved method for adhering silicone resin coating compositions to solid substrates.

Another object of this invention is to rejuvenate aged silicone resin coating compositions so that they recover their lost ability to provide adherent, abrasion resistant surfaces on plastic substrates.

These and other objects are accomplished by the invention herein which comprises a method for maintaining or rejuvenate initial adhesion to a thermoplastic acrylic-primed solid plastic substrate of an aqueous coating composition comprising a dispersion of colloidal silica in an aliphatic alcohol-water solution of the partial condensate of a silanol of the formula $RSi(OH)_3$, wherein R is selected from the group consisting of alkyl having from 1 to 3 carbon atoms and aryl, at least 70 weight percent of the silanol being $CH_3Si(OH)_3$, said composition containing 10 to 50 weight percent solids, said solids consisting essentially of 10 to 70 weight percent colloidal silica and 30 to 90 weight percent of the partial condensate, said composition also including a small, effective amount of a polysiloxane polyether copolymer and a small, effective amount of an ultraviolet screening agent, said method comprising adding a small effective amount of an aliphatic alcohol-water compatible liquid organic solvent for said partial condensate, said solvent also being capable of softening, but not dissolving said thermoplastic acrylic.

DETAILED DESCRIPTION OF THE INVENTION

The coating compositions used in this invention are prepared by hydrolyzing an alkyltrialkoxysilane or aryltrialkoxysilane of the formula $RSi(OR)_3$, wherein R is alkyl of from 1 to 3 carbons or aryl, such as phenyl, in an aqueous dispersion of colloidal silica, and then admixing an aggressive solvent compound with the resultant reaction product. Preferably they are aged at least about 5 days at a temperature of at least about 18° C., before the admixing step.

In the practice of the present invention, suitable aqueous colloidal silica dispersions generally have a particle size of from 5 to about 150 millimicrons in diameter. These silica dispersions are well known in the art and commercially available ones include, for example, those sold under the trademarks of Ludox (duPont) and Nalcoag (NALCO Chemical Co.). Such colloidal silicas are available as both acidic and basic hydrosols. For the purposes of this invention, wherein the pH of the coating compositions is on the basic side, basic colloidal silica sols are preferred. However, acidic colloidal silicas, wherein the pH is adjusted to a basic level, are also contemplated. In addition, it has been found that colloidal silicas having a low alkali content (e.g., $Na_2O$) yield a more stable coating composition. Thus, colloidal silica having an alkali content of less than 0.35% (calculated as $Na_2O$) are preferred. Moreover, colloidal silicas having average particle size of from 10 to 30 millimicrons are also preferred. A particularly preferred one for the purposes herein is known as Ludox LS, sold by duPont Company.

In accordance with this invention, the aqueous colloidal silica dispersion is added to a solution of a small amount of alkyltriacetoxysilane in alkyltrialkoxysilane or aryltrialkoxysilane. The temperature of the reaction mixture is maintained at about 20° C. to about 40° C. and preferably below 25° C. It has been found that in about six to eight hours sufficient trialkoxysilane has reacted to reduce the initial two-phase liquid mixture to one liquid phase in which the now treated silica (i.e., treated by admixture with the trialkoxy silane) is dispersed. In general, the hydrolysis reaction is allowed to continue for a total of about 24 hours to 48 hours, depending upon the desired viscosity of the final product. The more time the hydrolysis reaction is permitted to continue, the higher will be the viscosity of the product. After hydrolysis has been completed, the solids content is adjusted by the addition of alcohol, preferably isobutanol, to the reaction mixture. Other suitable alcohols for this purpose include lower aliphatic alcohols such as methanol, ethanol, propanol, isopropanol, n-butyl alcohol and t-butyl alcohol. Mixtures of such alcohols can be used, too. The solvent system should contain from about 20 to 75 weight percent alcohol to ensure solubility of the partial condensate (siloxanol). Optionally, additional water-miscible polar solvents, such as acetone, butylcellosolve and the like in minor amounts, like no more than 20 weight percent of the cosolvent system, can also be employed. The solids content of the coating composition of this invention is generally preferred to be in the range of from about 18 to 25%, most preferably about 20%, by weight of the total composition. The pH of the resultant coating composition is in the range of from about 3 to about 8, preferably from 7.1 to about 7.8, and especially preferably around about 7.2. If necessary, dilute base, such as ammonium hydroxide, or weak acid, such as acetic acid, may be added to the composition to adjust the final pH to this desired range.

The polysiloxane polyether copolymers, disclosed in said copending U.S. application Ser. No. 964,911, act as flow control agents, and are to be added to the compositions herein after the hydrolysis is completed. Preferably, however, they may be added to the composition after the initial solids content has been diluted with alcohol. The polysiloxane polyether copolymer prevents flowmarks, dirtmarks, and the like, on the surface of the substrate to which the coating is subsequently applied. For the purposes of this invention, the polysiloxane ether copolymer may be employed in an amount of from about 2.5 to about 15% by weight of the total solids of the composition. Most advantageous results may be achieved when the copolymer is utilized at about 4% by weight of the total solids. At these amounts, the polysiloxane polyether copolymer prevents marks on the substrate which impair visibility or are aesthetically detracting and has no significant deleterious effects on the otherwise good abrasion resistance, scribed adhesion, ultraviolet light resistance, moisture and humidity resistance of the coating. Moreover, the presence of the polysiloxane polyether copolymer additive is found to reduce the incidence of stress cracking in the hard coating.

Although the polysiloxane polyether copolymer slightly raises the viscosity of the coating composition, it does not accelerate the rate of viscosity increase with age of the composition, nor does it shorten the shelf-life of the composition. The polysiloxane polyether copolymer is completely compatible with the alcohol-water cosolvent system of the compositions herein and becomes a permanent part of the cured coating, not removed by washing, even with soap and water.

More specifically, some of the polysiloxane polyether copolymers which may be used in the practice of the invention herein are liquid organopolysiloxane copolymers having the formula:

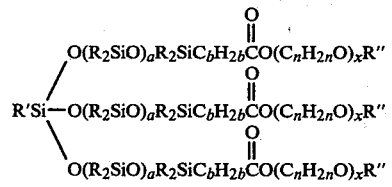

$$R'Si\left(\begin{array}{l} O(R_2SiO)_aR_2SiC_bH_{2b}\overset{\overset{\displaystyle O}{\|}}{C}O(C_nH_{2n}O)_xR'' \\ O(R_2SiO)_aR_2SiC_bH_{2b}\overset{\overset{\displaystyle O}{\|}}{C}O(C_nH_{2n}O)_xR'' \\ O(R_2SiO)_aR_2SiC_bH_{2b}\overset{\overset{\displaystyle O}{\|}}{C}O(C_nH_{2n}O)_xR'' \end{array}\right.$$

where R and R′ are monovalent hydrocarbon radicals; R″ is a lower alkyl radical; a has a value of at least 2, e.g., from about 2 to 40 or more; b has a value of from 2 to 3, n has a value of from 2 to 4 and x has a value of at least 5, e.g., from 5 to 100 or more.

Among the radicals represented by R and R′ in the above formula can be mentioned, for example, alkyl radicals, e.g., methyl, ethyl, propyl, butyl, octyl, etc.; cycloalkyl radicals, e.g., cyclohexyl, cycloheptyl, etc.; aryl radicals, e.g. phenyl, tolyl, naphthyl, xylyl, etc.; aralkyl, e.g., benzyl, phenylethyl, etc., alkenyl and cycloalkenyl, e.g., vinyl, allyl cyclohexenyl, etc.; and halogenated radicals of the aforementioned type, e.g., chloromethyl, chlorophenyl, dibromophenyl, etc. R″ is lower alkyl, e.g., an alkyl radical containing from 1 to about 7 carbon atoms, such as methyl, ethyl, propyl, butyl, isobutyl, amyl, etc. The preparation and description of these polysiloxane polyether copolymers is disclosed in U.S. Pat. No. 3,629,165, which is incorporated herein by reference. In the above formula R is preferably methyl, R′ is preferably methyl, R″ is preferably butyl, a is preferably 4, b is preferably 3, n is preferably 2.4, and x is preferably 28.5. Particularly suitable polysiloxane polyether copolymers for the purpose of this invention include the materials known as SF-1066 and SF-1141, made by General Electric Company, BYK-300, sold by Mallinckrodt, L-540, L-538, sold by Union Carbide, and DC-190, sold by Dow Corning.

The ultraviolet light absorbing compounds used in accordance with the present invention must be soluble in, and otherwise compatible with, the silicone resin hydrolyzate. A particularly preferred compound is 2,4-dihydroxybenzophenone, known commercially as Uvinul 400, sold by GAF. This compound is fully soluble in the silicone resin hydrolyzate, and furthermore is particularly effective in protecting polycarbonate from discoloration when the present coating compositions are applied to the surface thereof. Moreover, the presence of the 2,4-dihydroxybenzophenone does not detract from the otherwise excellent abrasion-resistance, moisture resistance, and adhesion, shelf-life and absence of color, afforded by the silicone resin hydrolyzate.

Other substituted hydroxybenzophenone ultraviolet light absorbers which have been found to be soluble in the silicone resin hydrolyzate and which prevent discoloration of the substrate are 2-hydroxy-4-methoxy benzophenone and 2,2′-dihydroxy-4-methoxybenzophenone.

Any amount of ultraviolet light absorber which is effective to prevent discoloration of the substrate to which the composition will be applied can be used herein. In general, it has been found that best results are obtained if the ultraviolet light absorber is employed in amounts of from 3–5% by weight of the total solids of the coating composition.

After hydrolysis has been completed, and in accordance with the improvement of the present invention, the solids content is adjusted by the addition of another solvent comprising an aggressive compatible organic liquid which is miscible with water and aliphatic alcohol and which are also aggressive (will etch) to the polyacrylate primer. Representative of such organic solvents include, for example polar compounds like 2-ethoxyethylacetate (Cellosolve acetate), methyl Cellosolve acetate, butyl Cellosolve acetate, ethyl acetate, propyl acetate, butyl acetate, acetone, 2-butanone, 1,5-pentanedione, cyclohexanone, nitropropane, diacetone alcohol and the like. As indicated, diacetone alcohol is preferred. It is also contemplated to use mixtures comprising at least two of these solvents. The total amount of solvent employed in the compositions herein is dependent upon the desired level of solids content. However, for the purposes herein, it has been found that the aggressive solvent should comprise at least about 1.0% and preferably at least about 2.5% by weight of the total composition. Up to about 50%, but preferably a maximum of about 35 wt. % of the total composition will be the aggressive solvent.

Diacetone alcohol is representative of the preferred solvents. Other β-hydroxyketone compounds preferred in the practice of the invention herein are those having the formula:

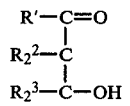

wherein $R^1$ is a monovalent hydrocarbon radical of from 1 to 18 carbon atoms and $R^2$ and $R^3$ are, independently, a monovalent hydrocarbon radical of from 1 to 18 carbon atoms or hydrogen.

Among the hydrocarbon radicals represented by $R^1$, $R^2$ and $R^3$ in the above formula can be mentioned, for example, alkyl radicals, e.g., methyl, ethyl, propyl, butyl, octyl, etc.; cycloalkyl radicals, e.g., cyclohexyl, cycloheptyl, etc.; aryl radicals, e.g., phenyl, tolyl, naphthyl, xylyl, etc.; aralkyl, e.g., benzyl phenylethyl, etc., alkenyl and cycloalkenyl, e.g., vinyl, allyl, cyclohexenyl, etc.; and halogenated radicals of the aforementioned type, e.g., chloromethyl, chlorophenyl, dibromophenyl, etc. In the above formula $R^1$ is preferably methyl, $R^2$ each are preferably hydrogen, and $R^3$ each are preferably methyl. As has been mentioned, the preferred compound is also known as diacetone alcohol, which is commercially available. Other suitable compounds of the above formula can easily be made by those skilled in this art.

The alkyltriacetoxysilane is used to buffer the basicity of the initial two liquid phase reaction mixture and thereby also temper the hydrolysis rate. While the use of alkyltriacetoxysilane is preferred herein, glacial acetic acid may be used in its place, as well as other acids such as organic acids like propionic, butyric, citric, benzoic, formic, oxalic, and the like. Alkyltriacetoxysilanes wherein the alkyl group contains from 1–6 carbon atoms can be used, alkyl groups having from 1 to 3 carbon atoms being preferred. Methyltriacetoxysilane is most preferred.

The silanetriols, $RSi(OH)_3$, hereinbefore mentioned, are formed in situ as a result of the admixture of the corresponding trialkoxysilanes with the aqueous medium, i.e., the aqueous dispersion of colloidal silica. Exemplary trialkoxysilanes are those containing methoxy, ethoxy, isopropoxy and n-butoxy substituents which upon hydrolysis generate the silanetriols and further liberate the corresponding alcohol. In this way, at least a portion of the alcohol content present in the final coating composition is provided. Upon the generation of the hydroxyl substituents bonding occurs to form

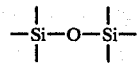

This condensation takes place over a period of time and is not exhaustive but rather the siloxane retains an appreciable quantity of silicon-bonded hydroxyl groups which render the polymer soluble in the alcohol-water cosolvent. This soluble partial condensate can be characterized as a siloxanol polymer having at least one silicon-bonded hydroxyl group per every three

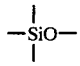

units.

The non-volatile solids portion of the coating composition used herein is a mixture of colloidal silica and the partial condensate (or siloxanol) of a silanol. The major portion or all of the partial condensate or siloxanol is obtained from the condensation of $CH_3Si(OH)_3$ and, depending upon the input of ingredients to the hydrolysis reaction, minor portions of partial condensate can be obtained, for example, from the condensation of $CH_3Si(OH)_3$ with $C_2H_5Si(OH)_3$ or $C_3H_7Si(OH)_3$; $CH_3Si(OH)_3$ with $C_6H_5Si(OH)_3$, or even mixtures of the foregoing. For optimum results in the cured coating it is preferred to use all methyltrimethoxysilane (thus generating all monomethylsilanetriol) in preparing the coating compositions herein. In the preferred coating compositions herein the partial condensate is present in an amount of from about 55 to 75 weight percent of the total solids in a cosolvent of alcohol and water, the alcohol comprising from about 50% to 95% by weight of the cosolvent.

The coating compositions of this invention will cure on a substrate at temperatures of, for example, 120° C. without the aid of an added curing catalyst. However, in order to employ more desirable milder curing conditions, buffered latent condensation catalysts will preferably be added. Included in this class of catalysts are alkali metal salts of carboxylic acids, such as sodium acetate, potassium acetate, potassium formate and the like. Amine carboxylates, such as dimethylamine acetate, ethanolamine acetate, dimethylaniline formate and the like, quaternary ammonium carboxylates such as tetramethylammonium acetate, benzyltrimethylammonium acetate, metal carboxylates, like tin octoate and amines such as triethylamine, triethanolamine, pyridine and the like are also contemplated curing catalysts herein. Alkali hydroxides, like sodium hydroxide and ammonium hydroxide can also be used as curing catalysts herein. Moreover, typical commercially available colloidal silica, especially those having a basic pH, contain free alkali metal base and alkali metal carboxylate catalysts will be generated in situ during the hydrolysis reaction herein.

The amount of curing catalyst can be varied within a wide range, depending upon the desired curing conditions. However, in general, catalyst in the amounts of from about 0.05 to about 0.5 weight percent, preferably about 0.1 weight percent, of the composition can be used. Compositions containing catalysts in these amounts can be cured on a solid substrate in a relatively short time at temperatures in the range of from about 75°–150° C. to provide a transparent abrasion resistant surface coating.

According to the present invention the coating composition can be applied to a variety of solid substrates by conventional methods, such as flowing or dipping, to form a continuous surface film. Solid plastic substrates which are especially contemplated herein are transparent and non-transparent plastics. More particularly, these plastics are synthetic organic polymeric substrates such as acrylic polymers, like poly(methylmethacrylate), polyesters, such as poly(ethylene terephthalate), poly(butylene terephthalate), etc., polyamides, polyimides acrylonitrile-styrene copolymers, styrene-acrylonitrilebudadiene copolymers, polyvinyl chloride, butyrates, polyethylene and the like. As noted above, the coating compositions of this invention are especially useful as coatings for polycarbonates, such as those polycarbonates known as Lexan®, sold by General Electric Company.

With respect to the acrylic primers, they preferably are deposited, e.g., by flowing, spraying or dipping, etc., from a primer composition comprising (a) from about 2 to about 10 parts by weight of a high molecular weight thermoplastic methacrylic ester polymer or copolymer selected from
  (1) polymers and copolymers comprising $C_1$–$C_6$ alkyl methacrylate;
  (2) polymer comprising $C_1$–$C_6$ alkyl methacrylate and a reaction product of glycidyl methacrylates and a hydroxy-benzophenone ultraviolet light screening agent;
  (3) copolymers comprising $C_1$–$C_6$ alkyl methacrylates and (A) a reaction product comprising units of methacrylic acid and γ-chloropropyltrimethoxysilane (B) acrylic or methacrylic acid, or (C), a mixture of (A) and (B); or
  (4) a mixture of any of the foregoing;

and from about 90 to 98 parts by weight of a solvent therefore, preferably a polar organic solvent of the type mentioned above, and especially preferably from 60 to 90 parts by weight of 2-ethoxyethanol; from 10 to 30 parts by weight of 4-hydroxy-4-methyl-2-pentanone; and from 0 to 20 parts of glacial acetic acid, per 100 parts by weight of (a) and solvent, combined.

The polymers and copolymers of $C_1$–$C_6$ alkyl methacrylate, embodiment (a)(1) include, for example, poly(methyl methacrylate), poly(n-butyl methacrylate) poly(methyl-cobutyl methacrylate) and the like. These are made by thermal or peroxide or azo-bis-isobutyronitrile catalyzed polymerization of the corresponding monomer, or mixture of monomers in well known bulk, suspension, emulsion, and the like techniques. In general, the molecular weight should be high, that is, at least 50,000, preferably at least 100,000. The upper limit is not particularly critical. A satisfactory range for most purposes is 100,000 to 250,000. A suitable commercial product is poly(methyl methacrylate) type designation Elvacite 2041, sold by DuPont Co.

A second embodiment (a)(2), includes a copolymerized ultraviolet screen in the acrylate primer. Copolymerization of 2,4-dihydroxybenzophenone or other hydroxy-functional benzophenone, e.g., 2,2′,4,4′-tetrahydroxybenzophenone with methyl methacrylate is achieved by functionalizing the benzophenone first by refluxing with glycidoxy methacrylate and a catalytic amount of a trialkyl amine. When all of the glycidoxy methacrylate has been consumed, the mixture is reduced in volume to remove the catalyst and methyl methacrylate is added. A preferred final ratio of the methacrylated uv screen to acrylate ester is 1:10, by weight. A suitable catalyst (azobisisobutyronitrile) is added and the solution is heated at 80°–120° C. for two hours. Two more portions of the catalyst are added at two hour intervals. Removal of the solvent gives an acrylate copolymer which is useful herein, alone, or in further admixture with poly(methyl methacrylate) homopolymer, etc.

A third embodiment, (a)(3), includes a copolymerized methacryloxypropyltrimethoxysilane and/or acrylic or methacrylic acid copolymer with a $C_1$–$C_6$ alkyl methacrylate. To make these, a solution of methacryloxypropyltrimethoxysilane 1–10 parts and/or acrylic acid or methacrylic acid 1–10 parts, methyl methacrylate 90–99 parts, a catalyst 1–5 parts, and an appropriate solvent, if desired, e.g., benzene, can be heated at 80° C. for 4 hours. A second portion of catalyst can be added and the solution can be heated for another four hours. The solution can be diluted to 2–10 parts of solids per 100 parts of composition, e.g., with 2-ethoxyethanol and 4-hydroxy-4-methyl-2-pentanone, and, optionally, acetic acid. If desired, also, poly(methyl methacrylate) homopolymer can be added. Heating, to complete solution, can be used. Filtration prior to use is often desirable.

In embodiments (a)(1) and (a)(3), if the substrate material is photolytically unstable, the addition of ultraviolet screening agents to the primer will prolong the life of the substrate and, thus, the final product. Selected uv screens can be added at 0.5 to 50% of the total solids. Illustrative such screening agents are benzophenones, triazoles, hindered amines, salicylate esters, metal complexes, other known screening and/or free radical quenching agents, and the like.

A two to 10 percent solids solution of the primer composition in the solvent is applied, .e.g, by dipping, flowing or spraying, and the primed substrate is air dried, e.g., for 20–30 minutes, e.g., at 15° to 30° C.

The air dried primed substrate is then flow, dip or spray coated with the silica filled curable organopolysiloxane top coat composition.

By choice of the proper formulation, application conditions and pretreatment, the coatings can be adhered to substantially all primed solid plastic substrates. A hard coating having all of the afore-mentioned characteristics and advantages is obtained by the removal of the solvent and volatile materials. The coating composition will airdry to a tack-free condition, but heating in the range of 75° C. to 200° C. is necessary to obtain condensation of residual silanols in the partial condensate. This final cure results in the formation of silsesquioxane ($RSiO_{3/2}$). In the finished cured coating the ratio of $RSiO_{3/2}$ units to $SiO_2$ will range from about 0.43 to about 9.0, preferably 1 to 3. A cured coating having a ratio of $RSiO_{3/2}$ to $SiO_2$, when R is methyl, of 2 is most preferred. The coating thickness can be varied by means of the particular application technique, but coatings of about 0.5 to 20 microns, preferably 2–10 micron thickness are generally utilized.

In order that those skilled in the art may better understand how to practice the present invention, the following examples are given by way of illustration and not by way of limitation.

Procedure A

A primer composition is prepared by charging a clean vessel with 76.0 parts by weight of 2-ethoxyethanol. To the agitated solution is added 4.0 parts of poly(methyl methacrylate) DuPont ELVACITE 2041, MW, 250,000. The mixture is heated to 100° C. and agitation is continued for two hours. The solution is cooled to about 30° C., and 20.0 parts of 4-hydroxy-4-methyl-2-pentanone, also known as diacetone alcohol, is added. The solids content is 3.8–4.2%. The product is filtered and is ready to use.

Procedure B

A top coat composition is prepared as follows:

Twenty-two and one-tenth parts by weight of Ludox LS, silica sol (aqueous dispersion of colloidal silica, average particle size is 12 millicrons, pH of 8.2 sold by duPont) is added to a solution of 0.1 parts by weight of methyltriacetoxysilane in 26.8 parts by weight of methyltrimethoxysilane. The temperature of the reaction mixture is maintained at 20° C. to 30° C., preferably below 25° C. The hydrolysis is allowed to continue for 24 hours. The solids content of the resultant reaction mixture is 40.5% and is diluted to about 20% solids with the addition of isobutanol. One gram (5% of solids) of silicone polyether flow control agent (SF-1066, General Electric) is added.

Thereafter 2,4-dihydroxybenzophenone (2,4-DHBP; Uvinul 400, GAF Corp.) is added to portions of the resin at 5% by weight of solids. After stirring to dissolve the compound, the product is again allowed to age for at least 72 hours.

Procedure C

Coating compositions are flow-coated onto a 6" by 8"×⅛" transparent Lexan® (poly(bisphenol-A carbonate)) panel primed with a 4% thermoplastic acrylic solution. After air drying for 30 minutes, the panel is cured for specified times at specified temperatures. The resultant hard coatings are observed for smoothness, clarity and evidence of flowmarks or stress cracking. After 500 Taber Abraser cycles (500 g load, CS-10F wheels) (ANSI-Z26.1-1977 section 5.17) the change in percent haze (Δ%H) is determined in a Gardner Haze Meter and reported. Adhesion is measured by cross-hatch tape adhesion, withstanding 3 pulls being denoted "pass"; adhesion is determined initially, and after being removed following the stated periods, from a water bath at 65° C.

EXAMPLES 1–2

A composition according to Procedure B is stored at about 20° C. for 44 days, then applied to transparent polycarbonate panels primed with the acrylic of Procedure A. After air drying for 30 minutes and then curing for 60 minutes at 120° C., the control plaque is scribed for cross-hatch adhesion. Three tape pulls with Scoth 710 (3M Company) tape causes some delamination near the center of the plaque. A similar test at the bottom of the plaque does not show adhesion failure.

Six days later, diacetone alcohol (4-hydroxy-4-methyl-2-pentanone) is added to the Procedure B composition at 10% by weight, and this composition is recoated. It is found that the addition of diacetone alcohol restores adhesion—there is no delamination during the scribed tape test.

The formulation according to Procedure B is repeated, and the composition is aged for 49 days at about 20° C. The coated plaque shows partial failure in the scribed adhesion test. To this aged composition is added diacetone alcohol at 5% by weight and another plaque is coated. The adhesion is restored—there is no delamination during the scribed tape test.

EXAMPLES 3–4

A composition according to Procedure B is divided into 3 portions. The first is designated Control A. To 670 g of the second is added 35 g of diacetone alcohol, and this is designated Example 3. To 630 g of the third is added 70 g of diacetone alcohol and this is designated Example 4. The formulations are stored at room temperature (18°–20° C.) and checked periodically for viscosity and coating properties. Weathering resistance is determined in a QUV accelerated Weathering Tester. The results are set forth in the Table:

TABLE

Properties of Panels Coated with Silicone Hand-Coat Composition Containing Diacetone Alcohol

| Room Temperature storage, days | Property Example | Viscosity at 25° C., Centistokes | | | Adhesion, 3 tape pulls at 3 locations** | | | Abrasion Resist., Δ % haze at 500 cycles | | | Weathering QUV Resistance(hours) | | |
|---|---|---|---|---|---|---|---|---|---|---|---|---|---|
| | | A* | 3 | 4 | A* | 3 | 4 | A* | 3 | 4 | A* | 3 | 4 |
| 0 | | — | 5.6 | 5.5 | — | — | — | | — | | — | — | — |
| 2 | | — | — | — | PPP | PPP | PPP | 2.7 | 2.7 | 2.6 | 825 | 825 | 663 |
| 19 | | 6.0 | 6.2 | 5.8 | FPP | PPP | PPP | 4.6 | 4.4 | 4.7 | — | — | — |
| 26 | | — | — | — | FPP | PPP | PPP | 3.9 | 4.0 | 3.2 | 423 | 494 | 494 |
| 33 | | 6.3 | 6.2 | 6.0 | FPP | PPP | PPP | 4.4 | 4.0 | 3.8 | — | — | — |
| 40 | | — | — | — | FFF | PPP | PPP | 4.8 | 3.6 | 5.1 | — | — | — |
| 49 | | — | — | — | FPP | PPP | PPP | 4.9 | 5.3 | 3.2 | — | — | — |
| 68 | | 6.7 | 6.6 | 6.3 | FPP | PPP | PPP | 14.4 | 4.4 | 5.1 | 68 | 546 | 546 |
| 76 | | — | — | — | — | PPP | PPP | — | 3.8 | 4.8 | — | — | — |
| 81 | | — | — | — | — | PPP | PPP | — | 4.3 | 3.3 | — | — | — |
| 84 | | — | — | — | — | PPP | PPP | — | 3.6 | 3.3 | — | — | — |
| 95 | | — | — | — | — | PPP | PPP | — | 8.2 | 6.9 | — | — | — |

**Top, middle, bottom - P = pass; F = fail
*Control - No diacetone alcohol
1 - 20:1 composition: diacetone alcohol
2 - 9:1 composition: diacetone alcohol Failure on the QUV Accelerated Weathering tester is either delamination (the scribed adhesion is checked during the condensation cycle) or cracking. The QUV cycle used is 8 hours UV irradiation at 70° C. and 4 hours condensation at 50° C. The Table indicates that the addition of diacetone alcohol to the hard coat composition prolongs its useful life at room temperature by maintaining adhesion and thus prolonging abrasion resistance and QUV resistance. The control coating shows reduced adhesion after 26 days of storage and poor abrasion resistance ($\Delta\%H_{500}>>$) after 68 days. In contrast, formulations 3 and 4, made according to this invention, maintained adhesion for more than 95 days and abrasion resistance for 84 days.

Obviously, other modifications and variations of the present invention are possible in the light of the above teachings. It is therefore to be understood that changes may be made in the particular embodiments described above which are within the full intended scope of the invention as defined in the appended claims.

We claim:

1. A method for maintaining or rejuvenating initial adhesion to a thermoplastic acrylic-primed solid plastic substrate of an aqueous coating composition comprising a dispersion of colloidal silica in an aliphatic alcohol-water solution of the partial condensate of a silanol of the formula $RSi(OH)_3$, wherein R is selected from the group consisting of alkyl having from 1 to 3 carbon atoms and aryl, at least 70 weight percent of the silanol being $CH_3Si(OH)_3$, said composition containing 10 to 50 weight percent solids, said solids consisting essentially of 10 to 70 weight percent colloidal silica and 30 to 90 weight percent of the partial condensate, said composition also including a small, effective amount of a polysiloxane polyether copolymer and a small, effective amount of an ultraviolet screening agent, said method comprising adding a small effective amount of an aliphatic alcohol-water compatible liquid organic solvent for said partial condensate, said solvent also being capable of softening, but not dissolving said thermoplastic acrylic, said solvent being a β-hydroxy ketone having the structural formula:

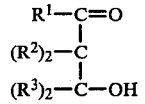

wherein $R^1$ is a monovalent hydrocarbon radical of from 1 to 18 carbon atoms and $R^2$ and $R^3$ are, independently, a monovalent hydrocarbon radical of from 1 to 18 carbon atoms or hydrogen.

2. A method as defined in claim 1 wherein the composition is aged prior to adding the solvent for at least 5 days at a temperature of at least about 18° C.

3. A method as defined in claim 1 wherein said composition has a pH of from 7.1 to about 7.8.

4. A method as defined in claim 1 wherein $R^1$ and $R^3$ are each methyl and $R^2$ are each hydrogen.

5. A method as defined in claim 1 wherein the aliphatic alcohol is a mixture of methanol and isobutanol.

6. A method as defined in claim 1 wherein said partial condensate is of $CH_3Si(OH)_3$.

7. A method as defined in claim 1 wherein said ultraviolet screening agent is a 2-hydroxybenzophenone compound.

8. A method as defined in claim 7 wherein said 2-hydroxybenzophenone compound is 2,4-dihydroxybenzophenone.

9. A method as defined in claim 3 wherein the pH is from about 7.2 to about 7.8.

10. A method as defined in claim 1 wherein said β-hydroxyketone compound is present in an amount of from about 2.5 to about 35% by weight of the composition.

11. A method as defined in claim 1 wherein the solid plastic substrate is comprised of a synthetic organic polymer.

12. A method as defined in claim 11 wherein the substrate is transparent.

13. A method as defined in claim 11 wherein said polymer is a polycarbonate.

14. A method as defined in claim 13 wherein said polycarbonate is transparent.

15. A method as defined in claim 13 wherein said polycarbonate is a transparent poly(bisphenol-A carbonate).

16. A method as defined in claim 1 which includes the subsequent step of curing the aqueous coating composition on said solid substrate.

17. A method as defined in claim 16 wherein the curing step is carried out at a temperature in excess of 100° C. but below that at which the substrate significantly softens.

* * * * *